United States Patent [19]

Kaldenbach

[11] Patent Number: 4,927,296

[45] Date of Patent: May 22, 1990

[54] METHOD AND INSTALLATION FOR DISPLACING A JACKET OF AN ARTIFICIAL ISLAND IN RELATION TO AN UNDERWATER BASE

[75] Inventor: Willem P. Kaldenbach, The Hague, Netherlands

[73] Assignee: Allseas Engineering B.V., Netherlands

[21] Appl. No.: 301,058

[22] Filed: Jan. 25, 1989

[30] Foreign Application Priority Data

Oct. 4, 1988 [NL] Netherlands ..... 8802431

[51] Int. Cl.[5] ..... E02D 25/00

[52] U.S. Cl. ..... 405/206; 405/203; 405/209; 114/258

[58] Field of Search ..... 405/195, 203, 204, 205, 405/206, 209; 114/258

[56] References Cited

U.S. PATENT DOCUMENTS 3,054,267 9/1962 Alcorn et al. ..... 405/209
3,078,680 2/1963 Wepsala .
3,859,804 1/1975 Koehler et al. .
4,683,832 8/1987 Dysarz ..... 114/258
4,714,382 12/1987 Khachaturian ..... 405/204

FOREIGN PATENT DOCUMENTS 2165188 4/1986 United Kingdom ..... 405/209

*Primary Examiner*—Randolph A. Reese
*Assistant Examiner*—John Ricci
*Attorney, Agent, or Firm*—Watson, Cole, Grindle & Watson

[57] ABSTRACT

An artificial island structure which is constructed on land can be conveyed to and placed in a vertical standing position on an underwater base site by loading the island structure, while horizontal, on a floating buoyant carrier, transporting the carrier with island structure thereon to a large displacement buoyant vessel, journalling one end of the carrier to the vessel, transporting the vessel with carrier and island structure to a position over the underwater base site, ballasting the carrier until it swings to an upright position, suspending the upright island structure from the vessel, disconnecting the carrier from the island structure, and lowering the island structure onto the underwater base site.

16 Claims, 8 Drawing Sheets

Figure 1:
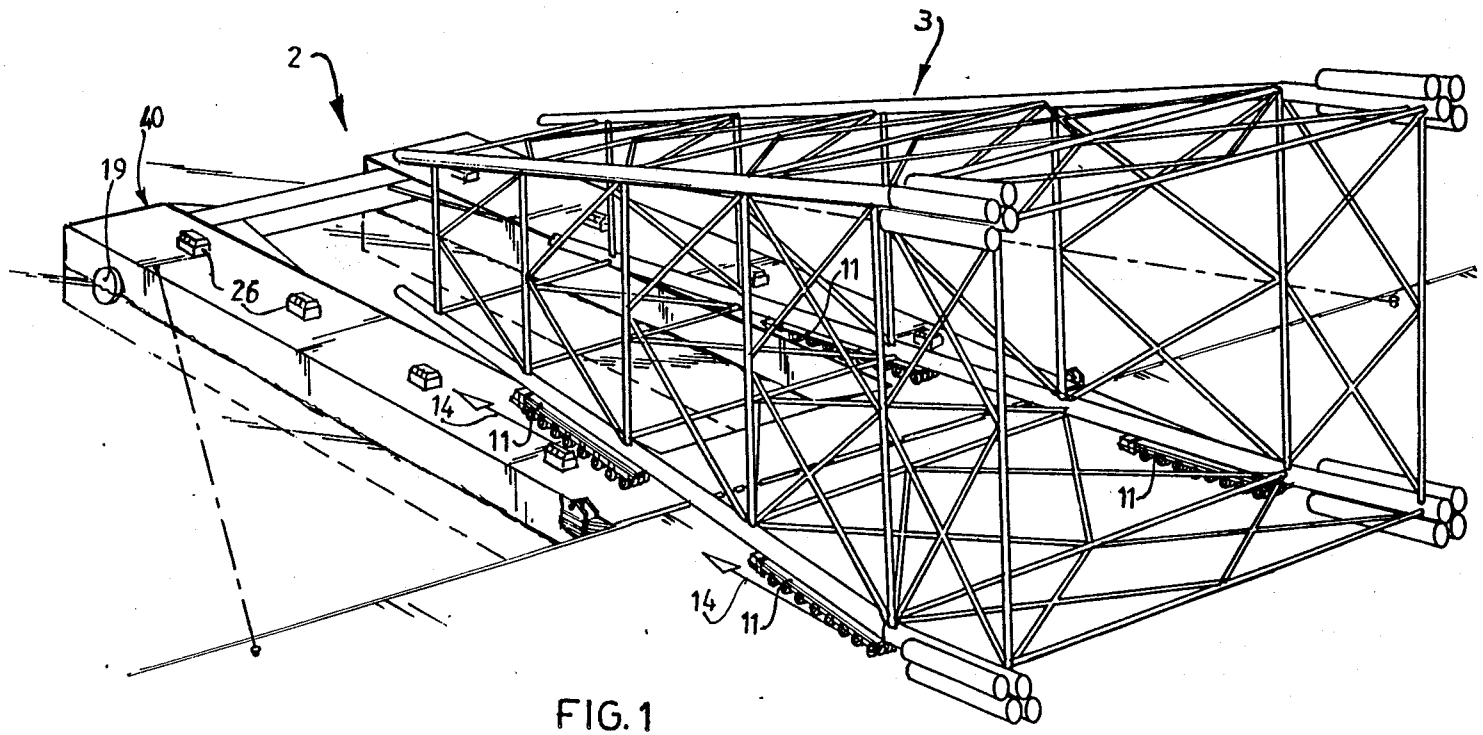

METHOD AND INSTALLATION FOR DISPLACING A JACKET OF AN ARTIFICIAL ISLAND IN RELATION TO AN UNDERWATER BASE

The invention relates to a method for displacing a jacket of an artificial island in relation to an underwater base.

In the known method of the above mentioned kind the jacket is pushed from a floating pontoon into the water. The jacket, which may for example be 100 meters long, is thereby subjected to a large measure of local loading during the sliding contact with the edge of the pontoon. The jacket has for this reason to be strongly constructed to be able to withstand this loading. This requires the use of much costly material.

The invention has for its object to provide a method whereby maneuvering of the jacket is carried out such that great localized loading does not occur and the jacket can therefore be constructed sufficiently robustly with less material. To this end the method according to the invention has the feature that the jacket is displaced between a lying position and a downward directed position while being supported by means of a carrier which is suspended for pivoting on two vessel elements situated on either side of the carrier.

The invention further provides an installation particularly suitable for the performing of the method according to the invention.

The invention will be better understood by reference to the following description, taken with reference to a the accompanying drawings.

Figure 2:
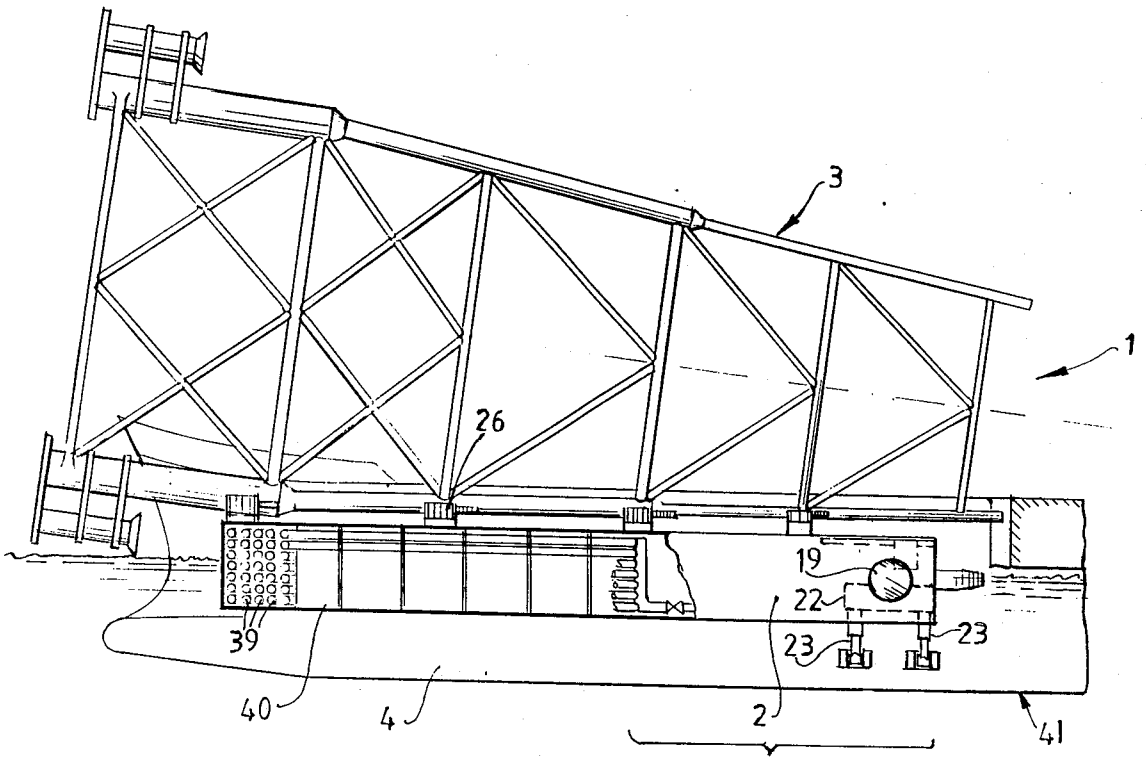
Figure 3:
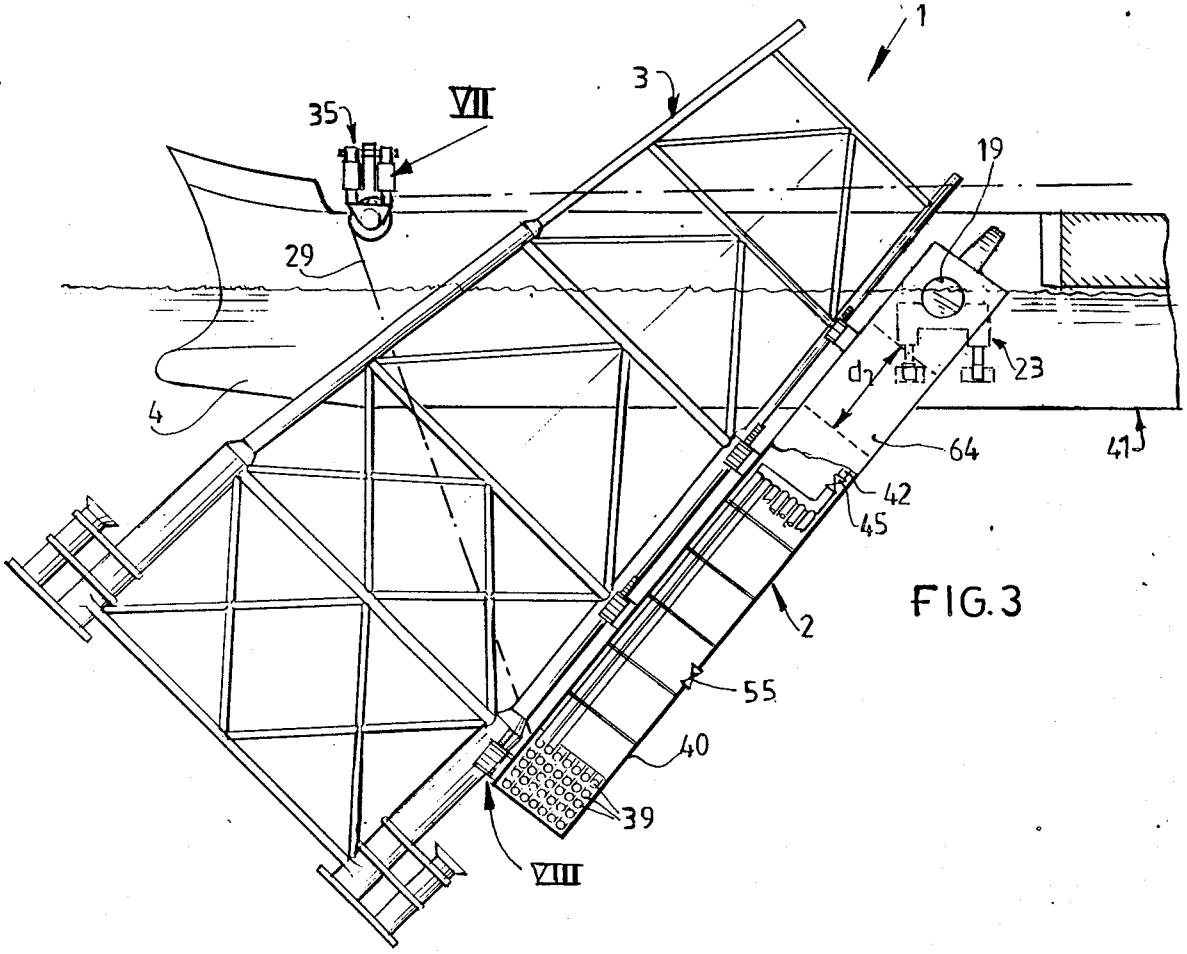
Figure 4:
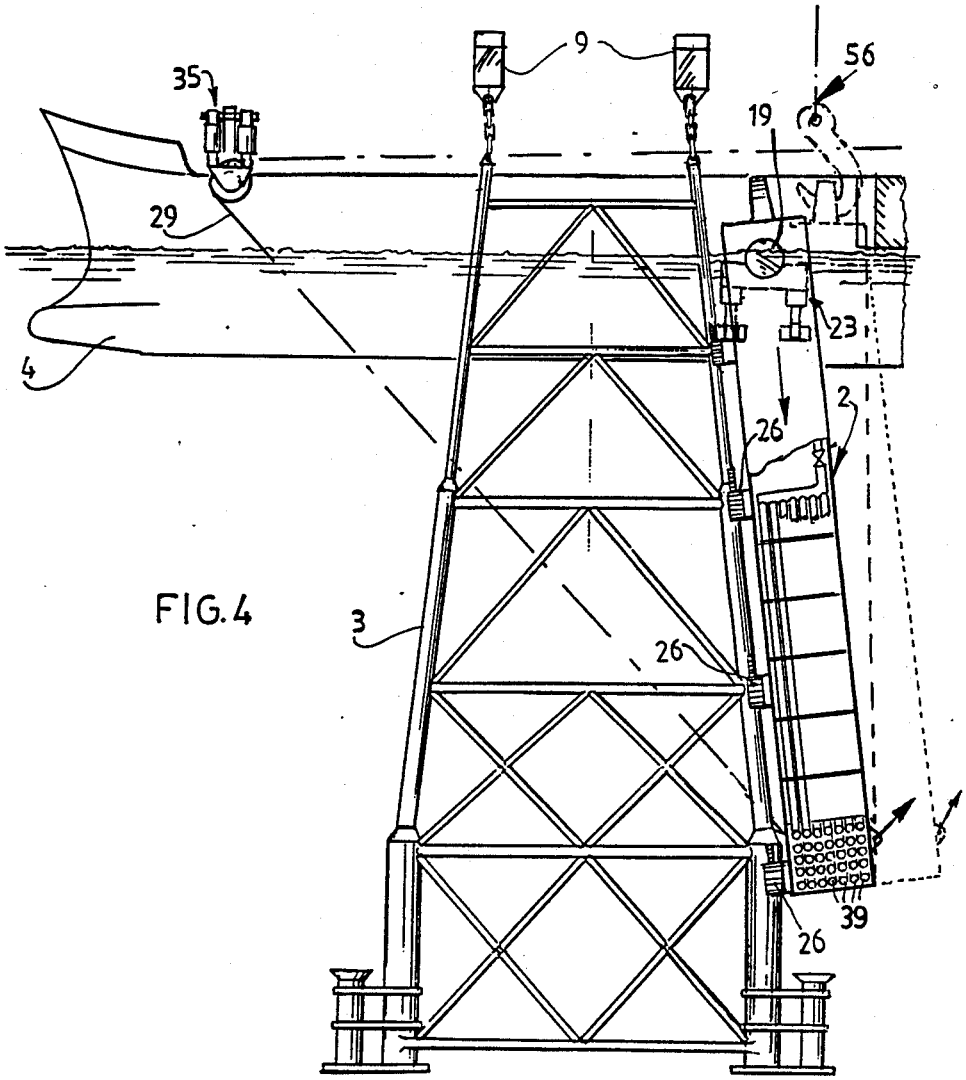
Figure 5:
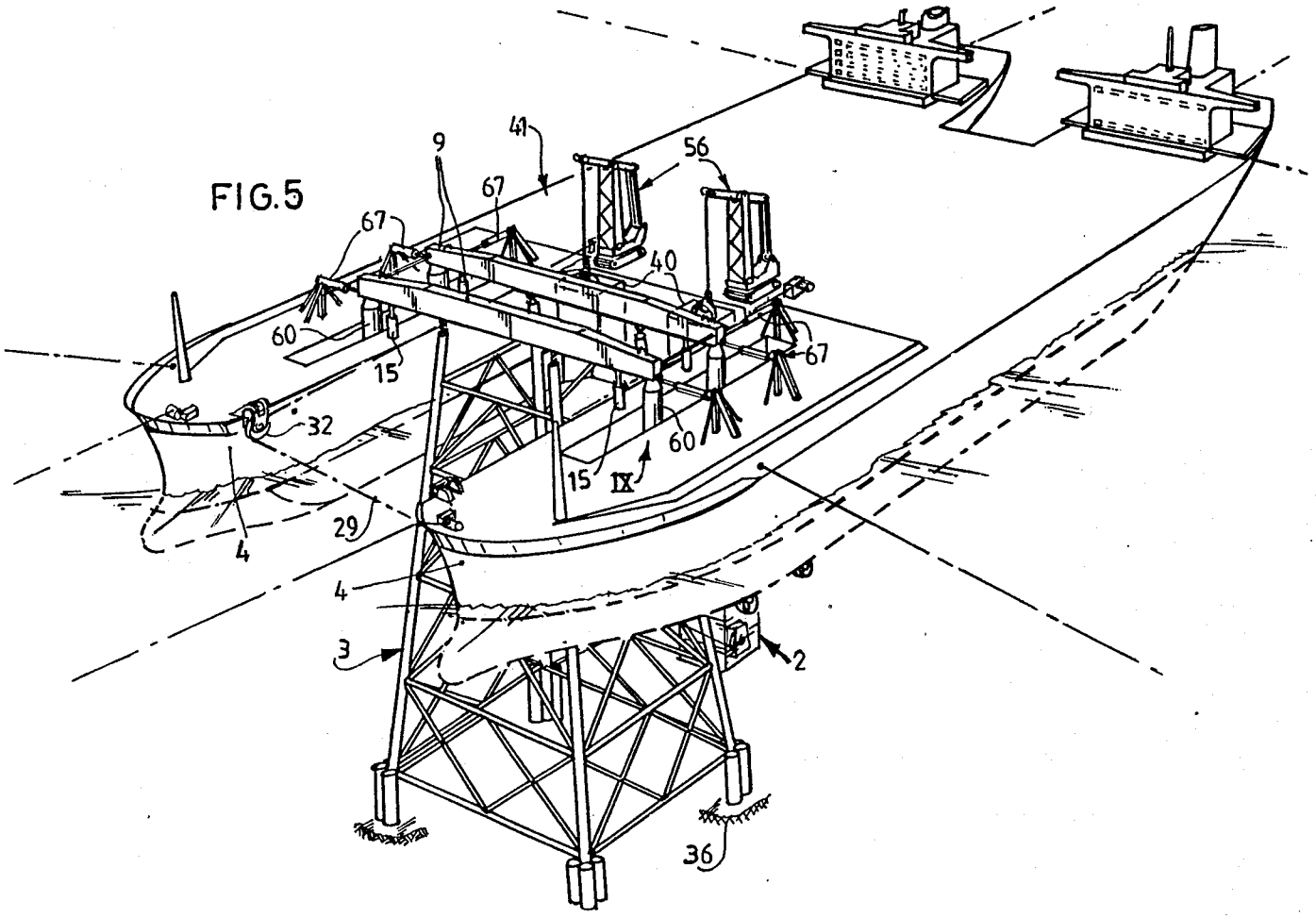
Figure 6:
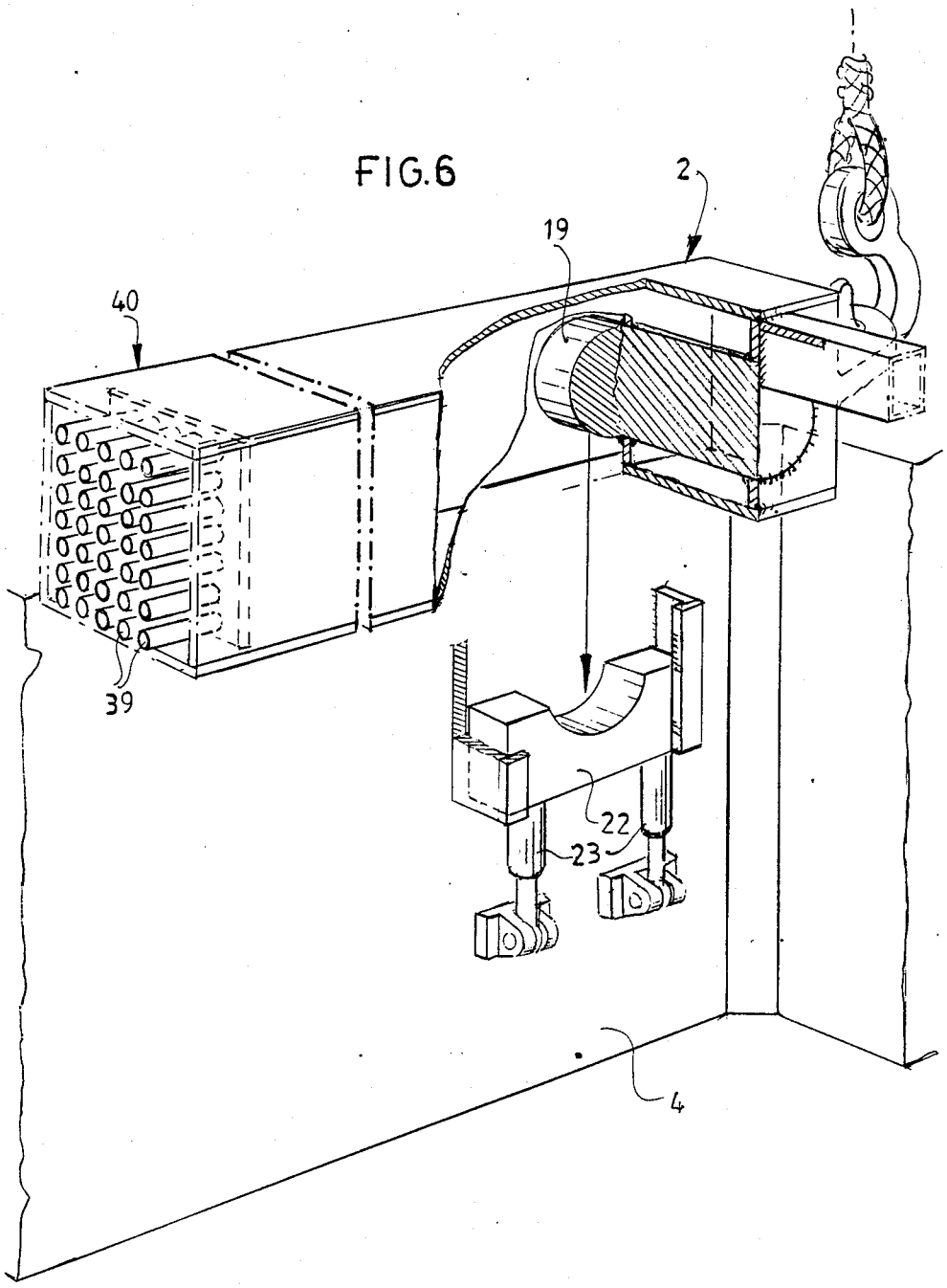
Figure 8:
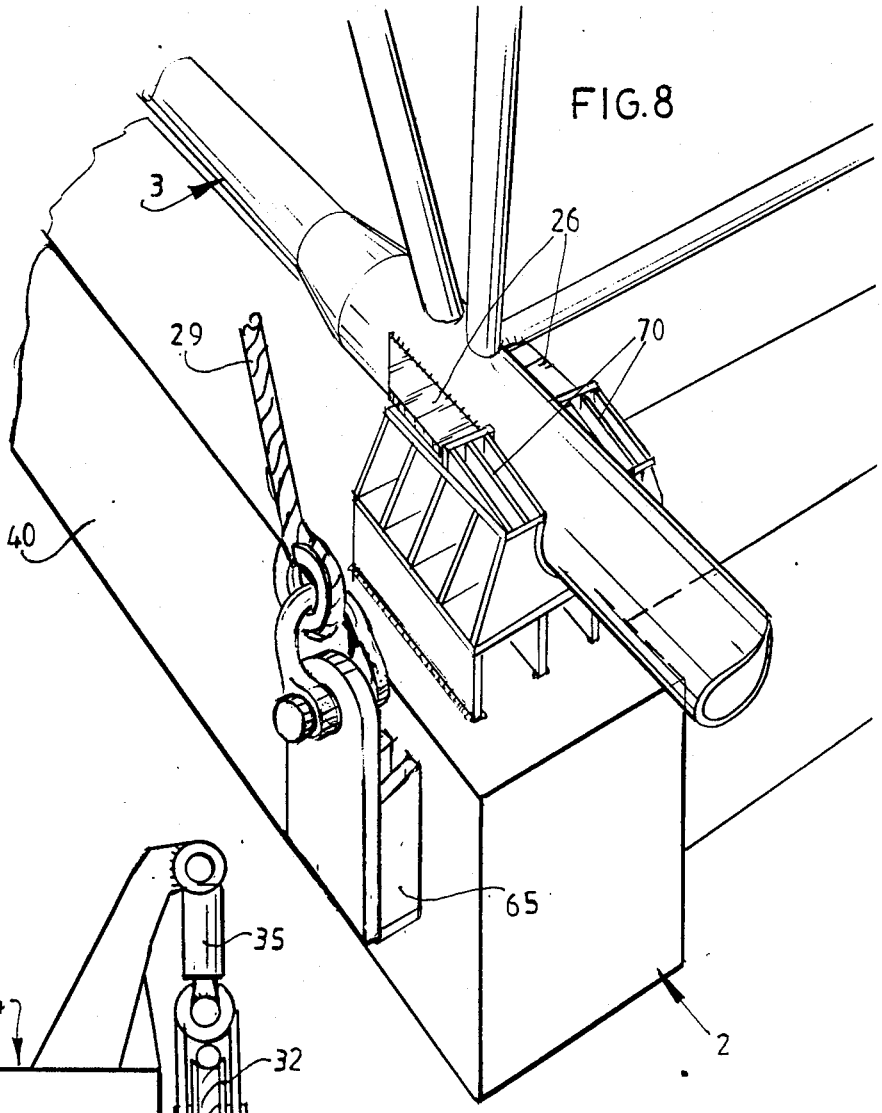
Figure 7:
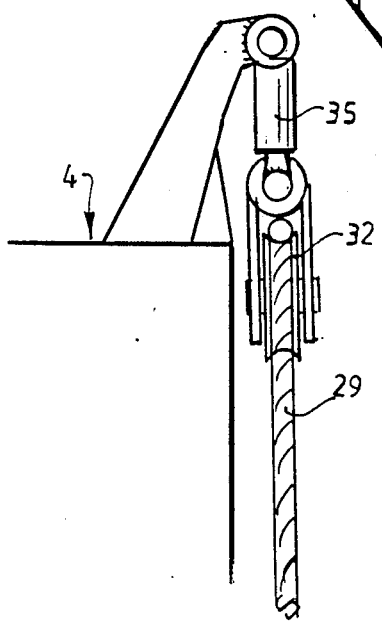
Figure 9:
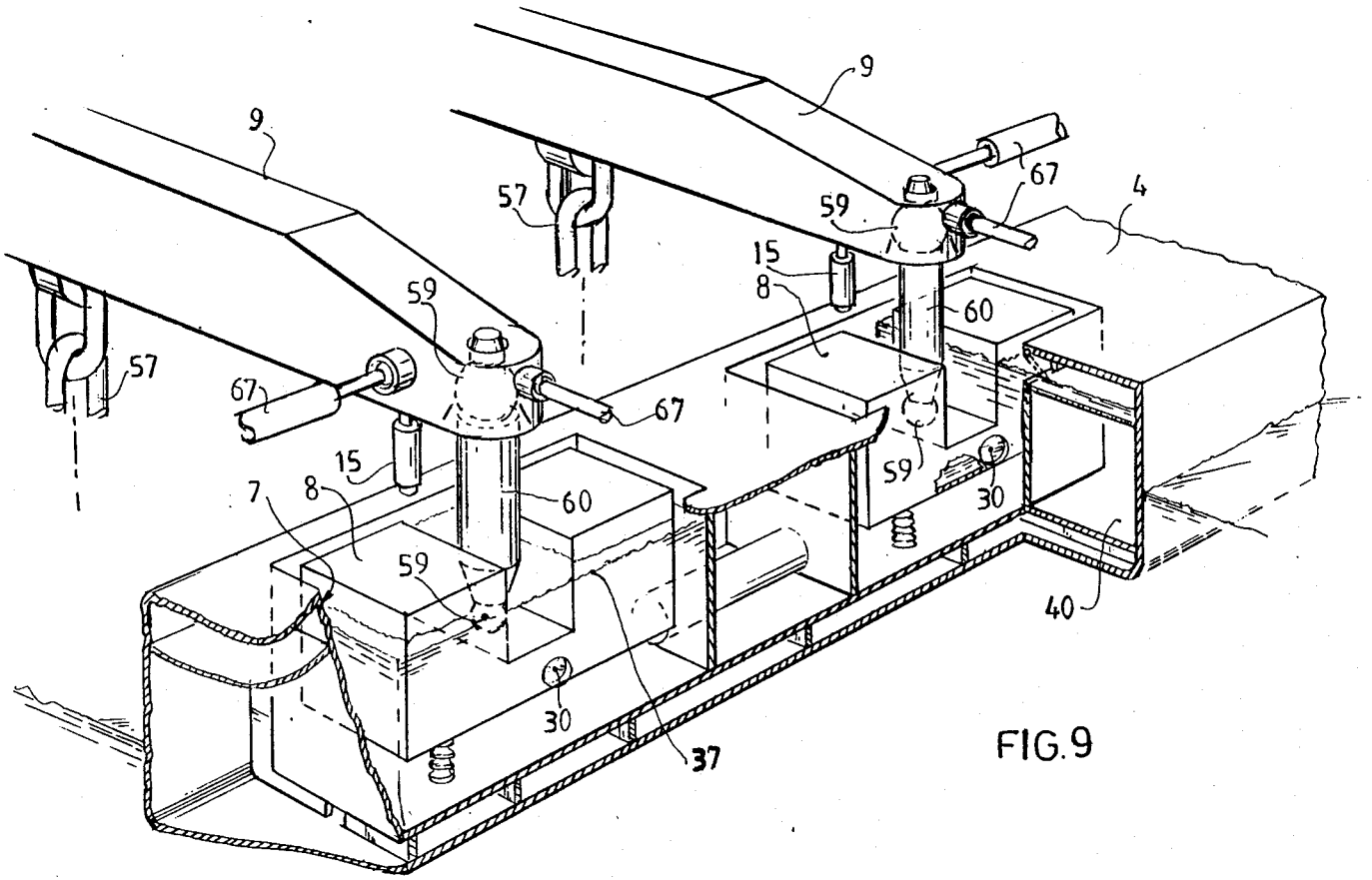

In the drawings in schematic form:

FIGS. 1–5 show successive steps during the performing of a preferred embodiment of the method according to the invention, FIG. 6 shows on a larger scale a perspective view of detail VI from FIG. 2, FIG. 7 shows on a larger scale a perspective view of detail VII from FIG. 3, FIG. 8 shows on a larger scale a perspective view of detail VIII from FIG. 3, and FIG. 9 shows on a larger scale a perspective, broken away view of detail IX from FIG. 5.

With the method according to the invention a jacket 3 manufactured onshore is rolled from the quayside as according to arrows 14 by means of separate roller means 11 onto a carrier 2 to which it is welded for a firm attachment during transport. The carrier 2 which is thus loaded with jacket 3 and which has sufficient buoyancy for this purpose, is towed in the water to the vessel 41 of the installation 1, anchored for instance at sea outside a harbour, and arranged between two vessel elements 4 of vessel 41 disposed at an interval from one another. Two bearing shafts 19 of the carrier 2 are accommodated in a ballasted vessel 41 in bearings 22 which are suspended by means of hydropneumatic buffers 23 for example from the vessel elements 4, and during transport the carrier 2 is further suspended on the vessel elements 4 by means of consoles 65 welded in position on vessel elements 4. The vessel 41 is then freed of ballast and navigated to the placing location. The consoles 65 are there cut free while the carrier 2 is then supported by means of cables 29 which run via guide pulleys 32 to winches, these guide pulleys 32 being carried by buffers 35. Hydraulically retractable consoles can also be considered for use instead of removable consoles 65. After the vessel 41 is anchored above the placing location in the required direction, the jacket 3 is set in position on the underwater base 36 as follows.

In order to carry the carrier 2 together with the jacket 3 from the prone position into the downward directed position, the free end of carrier 2 is ballasted with water via valves 55 with the cables 29 under spring tension. For this purpose the carrier 2 comprises watertight chambers 40 in the lower part of which are arranged pressure resistant, cylindrical air tanks 39 which may optionally be placed under a pressure via an air line 42 with a valve 45, this pressure being high enough to withstand the high external water pressure of for example 10 bar.

While the carrier 2 with the jacket 3 connected thereto hangs on the bearings 22, the jacket 3 is suspended by means of chains 57 to girders 9 which are supported by floater bodies 8 accommodated in liquid baths 7 of the vessel elements 4.

The vessel 41 preferably consists of two identical supertankers which each form a vessel element 4. The loading spaces thereof are converted into liquid baths 7 in which are arranged floater bodies 8. The latter consist of tanks of such a large volume that their buoyancy can together bear at least the weight of the jacket 3, carrier 2, floater bodies 8 and supporting girders 9 when they are floating in water 10 present in the liquid baths. The floater bodies 8 are raised by filling liquid baths 7 with water and by removing water from the floater bodies 8.

The carrier 2 is then released from the upper part of jacket 3 by adding a slight additional water ballasting to the carrier 2, which results in the weld plates 26 being released from the associated consoles 70 (FIG. 8). Carrier 2 is subsequently placed at a distance from jacket 2, using for instance a lifting device 56 and a cable 69, into the position drawn in FIG. 4 in dashed lines. Ballast water can if required be thereby removed from the carrier 2. The jacket 3, which is positioned for example 4 meters above the base 36, is then set down thereon by bringing the floater bodies 8 down to a lower level.

Because the floater bodies 8 support the jacket 3 and because swell compensators 15 are arranged between the girders 9 and the vessel elements 4, the swell of the vessel 41 during this operation is transmitted only to a very small extent and with small forces onto jacket 3. The girders 9 support on the floater bodies 8 via columns 60 which are provided with ball and socket joints 59. Girders 9 are held in position with control cylinders 67 provided with ball and socket joints 68. Jacket 3 is first moved to a position a short distance, for example 1 meter, above the base 36 and then, preferably quickly, set down thereon. To this end the water level 37 in the liquid baths 7 is lowered rapidly and/or the floater bodies 8 are rapidly ballasted with water. Valves 30 are opened for this purpose to allow water to flow from the baths 7 into floater bodies 8. When jacket 3 is standing on the base 36 the chains 57 are released, the installation 1 is removed and the carrier 2 is suspended in the bearings 22 and raised to the prone position.

It is noted that a jacket 3 standing on the base 36 can be removed using the installation 1 by performing the method substantially in the reverse manner. Means for this purpose (not drawn) are present to pump either water out of the floater bodies 8 and out of storage tanks 40 or surrounding outside water into the baths 7.

The installation 1 can be used for the placing and removal of jackets 3 at varying water depths. To this end a piece 64 of the carrier 2 of suitable length d is then inserted therein by means of welding operations or removed therefrom to adapt the total length of carrier 2 to the depth of water or length of the jacket 2 occurring in each case. Using one and the same installation 1 a jacket 3 can in this way be placed or removed at a depth of water of 80, 100. 120 or 150 meters.

We claim:

1. The method of placing an artificial island structure in a vertical standing position on an underwater base site, which comprises the steps of:

(a) loading the artificial island structure, while horizontal, from land onto a buoyant carrier disposed in water, (b) affixing the horizontal artificial island to the carrier, (c) transporting the carrier through the water to a large displacement buoyant vessel, (d) journalling one end of the carrier upon the vessel, (e) transporting the vessel to a position over the underwater base site, (f) ballasting the carrier until the carrier swings vertically downwardly about said one end of the carrier to an upright position of the carrier and artificial island affixed thereto, (g) suspending the upright artificial island from the vessel, (h) disconnecting the carrier from the artificial island structure, and (i) lowering the artificial island structure relative to the vessel until it is supported in vertical position on the underwater base site.

2. The method as defined in claim 1 wherein step (b) comprises temporarily welding the horizontal island structure to the carrier and step (g) comprises ballasting the carrier sufficiently to break the temporary weld.

3. The method as defined in claim 1, including between steps (d) and (e) the step (d') of supporting a second end of the carrier upon the vessel, and between steps (e) and (f) the step (e') of discontinuing the support of the second end of the carrier upon the vessel.

4. The method as defined in claim 1, wherein step (g) comprises attaching said artificial island to beam means supported by floater bodies floating in liquid-containing chambers in said vessel, and wherein step (i) includes removing liquid from said liquid-containing chambers to lower said beam means and thus said artificial island.

5. The method as defined in claim 4, wherein simultaneously with removing liquid from said liquid-containing chambers in step (i) liquid is supplied into said floater bodies.

6. Apparatus for placing an artificial island structure in a vertical standing position on an underwater base side, which comprises:

buoyant carrier means for supporting the artificial island structure and moving the artificial island structure over water to a vessel means, means for affixing the artificial island to the carrier means, vessel means for transporting the carrier means with affixed island structure to a location over the underwater base site, means for journalling one end of the carrier means upon the vessel means, means for ballasting the carrier means to swing it vertically downwardly about said one end thereof to an upright position of the carrier means and artificial island affixed thereto, means for suspending the upright artificial island from the vessel means, and means for lowering the artificial island structure relative to the vessel until it is supported in vertical position on the underwater base site.

7. Apparatus as defined in claim 6 wherein said vessel means includes mechanism for ballasting the vessel means with water.

8. Apparatus as defined in claim 6, wherein said vessel means includes two spaced apart vessel elements between which said carrier means can be moved and supported.

9. Apparatus as defined in claim 8, wherein said carrier means includes bearing shafts extending away from respective opposite sides thereof at said one end thereof, and wherein facing sides of said spaced apart vessel elements include respective bearings in which said bearing shafts are respectively mountable.

10. Apparatus as defined in claim 9, including pneumatic buffer means attached to each said bearing.

11. Apparatus as defined in claim 8, including support means for temporarily supporting a second end of said carrier means upon the vessel means.

12. Apparatus as defined in claim 8, wherein each of said vessel elements defines a first liquid-containing chamber, wherein a floater body means is positioned in the first liquid-containing chamber in each of said vessel elements, and wherein said means for suspending the upright artificial island from said vessel means comprises a first beam member having opposite ends respectively supported on said floater body means in said first liquid-containing chambers.

13. Apparatus as defined in claim 12, including first chain means connectable between said first beam member and said artificial island.

14. Apparatus as defined in claim 12, wherein each of said vessel means defines a second liquid-containing chamber, wherein a floater body means is positioned in each of said second liquid-containing chambers, and wherein said means for suspending the upright artificial island from said vessel means comprises a second beam member having opposite ends respectively supported by said floater body means in said second liquid-containing chambers.

15. Apparatus as defined in claim 14, including second chain means connectable between said second beam member and said artificial island.

16. The apparatus as defined in claim 12, wherein said floater body means define internal liquid-containing spaces, the amount of liquid therein determining their buoyancy.

* * * * *